United States Patent [19]

Springer

[11] 4,412,368

[45] Nov. 1, 1983

[54] SAFETY-PINS

[75] Inventor: Paul H. Springer, West Midlands, England

[73] Assignee: Newey Goodman Limited, Birmingham, England

[21] Appl. No.: 318,698

[22] Filed: Nov. 6, 1981

[30] Foreign Application Priority Data

Aug. 11, 1980 [GB] United Kingdom ..... 8035950

[51] Int. Cl.[3] ..... A44B 9/14

[52] U.S. Cl. ..... 24/158; 24/161

[58] Field of Search ..... 24/155 BB, 155 C, 155 RB, 24/153.1, 155 R, 156 R, 158 R

[56] References Cited

U.S. PATENT DOCUMENTS

| | | | |
|---|---|---|---|
| 2,507,332 | 5/1950 | Chapman | 24/156 R |
| 2,519,915 | 8/1950 | Manolopulos | 24/156 R |
| 2,668,996 | 2/1954 | Kummli | 24/258 R |
| 2,772,462 | 12/1956 | Trachsler | 24/158 R |
| 2,893,091 | 7/1959 | Mitchell | 24/158 R |
| 3,267,541 | 8/1960 | Chrones | 24/158 R |

FOREIGN PATENT DOCUMENTS

| | | | |
|---|---|---|---|
| 793060 | 4/1958 | United Kingdom | 24/158 R |

*Primary Examiner*—Gene Mancene
*Assistant Examiner*—K. Schulze
*Attorney, Agent, or Firm*—Scrivener Clarke

[57] ABSTRACT

A safety-pin is provided with a sheath (16;33) that fits over the cap (12;28) of the pin and can be slid between a release state and a locking state. During assembly the sheath is slid onto the cap and then at least one lug (21A,21B;38) on the sheath is bent to prevent subsequent removal of the sheath, and another deformable part (22A,22B;39)of the sheath is deformed to engage the cap sufficiently tightly as to prevent unwanted movement of the sheath. The sheaths can be slid onto the caps in either of two different ways and have redundant lugs (20A,20B;37) and deformable parts (23A,23B) so arranged that whichever way a sheath is oriented relatively to the cap, it has a lug or lugs and a deformable part suitably positioned for deformation. The sheaths are therefore fitted to the caps randomly orientated. The cap may be single-sided (28) or double-sided (12).

9 Claims, 7 Drawing Figures

SAFETY-PINS

Figure 1:
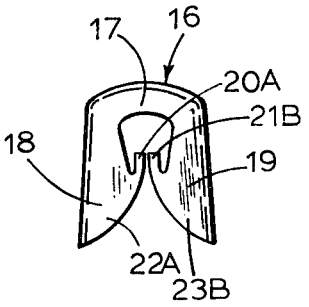

This invention relates to safety-pins, and in particular to safety-pins of the well-known kind (hereinafter referred to as a safety-pin of the kind specified) capable of being moved between open and closed states, the safety-pin comprising first and second wire limbs, the first wire limb having a cap at one end and being connected at the other end to the second wire limb, an end portion of the second limb remote from the connection with the first limb being releasably engaged with the cap when the pin is in its closed state and being free from the cap when the pin is in its open state, said end portion, when engaged with the cap, being disposed in a recess in the cap opening towards said first wire limb and being retained there owing to the resilience of the pin or part thereof.

It is normal for said end portion of the second limb to be shaped so as to present a sharp point, though this is not essential.

When safety-pins are to be used for certain purposes, such as for securing diapers on infant children, it is desirable to provide locking means enabling the pins to be releasably locked in their closed states so as to prevent the pins being unintentionally or inadvertently opened and possibly causing injury or damage.

A known form of locking means (hereinafter referred to as locking means of the form specified) comprises a sheath fitted over the cap of a safety-pin and slidable between locking and release states, the sheath including blocking means, the arrangement being such that when the pin is in its closed state and the sheath is in its locking state the blocking means prevents the pin being moved to its open state, but when the sheath is in its release state the blocking means no longer prevents the pin being moved to its open state.

A design of safety-pin of the kind specified, having locking means of the form specified, is described and illustrated in the complete specification of British Pat. No. 793,060 granted to George Goodman Limited.

In the assembly of a sheath with a safety-pin of the kind specified, a partially formed sheath is slid over the cap of the pin, and at least one forming operation is carried out on the sheath to provide retaining means such as to prevent the sheath being removed from the cap again, though not of course preventing movement of the sheath between its locking and release states.

A problem often tends to arise in the assembly of the sheaths with the pins owing to the need for the sheath to be correctly orientated in relation to the cap onto which it is slid. Most practical designs of sheath have been of a shape that is asymmetrical, even in the partially formed state. In consequence it has been necessary to ensure that the partially formed sheath is correctly orientated relative to the cap of the pin before the sheath is slid onto the cap. The designs of sheaths have generally been such that if a sheath is incorrectly orientated, by being turned through half a complete revolution from its correct orientation, it can still be slid onto the cap; but, when an attempt is made to carry out the subsequent forming operation or operations, either no forming operation is effected or the sheath is malformed so that the resultant assembly is faulty. With a view to avoiding this problem, or at least reducing it to an acceptable level, it has hitherto been the usual practice for the sheaths to be slid onto the caps by hand. The workers carrying out this assembly operation have either had to inspect each pin and sheath visually to ensure that they are correctly orientated each relatively to the other, or had to detect in some other way whether the pin and sheath are correctly orientated; some workers are able to assess by feel whether the correct orientation has been achieved. With a view to enabling this slow and tedious job to be carried out automatically, an attempt has been made to provide automatic apparatus for distinguishing the initial orientation of the sheaths as they are supplied to a station where they are to be slid onto the caps, and for rejecting the incorrectly orientated sheaths before assembly is effected. In use the apparatus has not been particularly successful as it has necessarily had to include highly sensitive means to discriminate between the two possible orientations of each sheath. That discrimination is difficult because in general the difference in appearance between sheaths orientated in the two different manners is relatively slight.

An object of the present invention is to enable that difficulty to be avoided.

From one aspect the present invention consists in a method of assembling a safety-pin of the kind specified with locking means of the form specified, and which comprises the steps of providing locking means which in a partially formed state is capable of being slid onto the cap of the safety-pin in either of two different orientations, differing from each other by a rotation through half a complete revolution, sliding the sheath onto the cap in either of those orientations at random, and carrying out at least one forming operation on the sheath, the operation being of a kind that is independent of the orientation of the sheath and serves to deform at least one lug on the sheath so that it forms retaining means such as to prevent the sheath being removed from the cap again.

From another aspect the present invention consists in a safety-pin assembly comprising a safety-pin of the kind specified and locking means of the form specified, assembled by the method outlined in the last preceding paragraph.

Hitherto it has been the practice when manufacturing safety-pins with locking sheaths to orientate each sheath in a unique, predetermined manner relative to the cap of the associated pin. The basis of the present invention is that it is possible to manufacture such safety-pins by a method in which each sheath is assembled with its associated cap in either one of two different orientations at random.

As at least one lug on the sheath is deformed after assembly, in a forming operation that is independant of the orientation of the sheath relative to the cap, it is normally necessary to provide at least one pair of lugs on the sheath only one lug of the pair or of each pair being deformed to form retaining means, the one deformed depending on the orientation of the sheath relative to the cap.

The cap may be of the kind, referred to below as a single-sided cap, which is so shaped as to permit the end portion of the second limb to enter the recess from one side only (the open side) of the cap during manipulation of the pin to its closed state. In one design of single-sided cap, the side opposite to the open side of the cap is completely closed. The sheath for a single-sided cap preferably includes a pair of lugs, one on each side of the sheath, the arrangement being such that, during assembly of the sheath with the pin, only one lug of the pair is deformed to form retaining means, the deformed lug entering the open side of the cap. That deformed lug may also constitute blocking means. The lugs may be offset from each other when viewed from either side of the sheath.

A more usual kind of cap is one that is so shaped as to permit the end portion of the second limb to enter the recess from either side of the cap at will. This is referred to below as a double-sided cap. During manipulation of the pin towards its closed state the end portion of the second limb of the pin enters the cap from either side at will, is aligned with the recess and then allowed to enter the recess. In order to assist the user to align the end portion of the second limb with the recess, a double-sided cap usually includes a tongue projecting into or close to the mouth of the recess from a part of the cap adjacent to the first wire limb and facing the mouth of the recess. When such a tongue is present it is impossible or at least difficult to manipulate the second limb in such a manner that it passes in one continuous movement through the cap from one side to the other. Instead of being able to pass straight through the cap in that way, the end portion of the second limb normally strikes the tongue and is guided by the tongue into the recess as the second limb is progressively released by the user.

The sheath for a double-sided cap preferably includes two pairs of lugs, the two lugs of each pair being on opposite sides of the sheath, and the lugs being so disposed that only one lug of each pair is deformed to form retaining means, the deformed lugs being on opposite sides of the sheath. The deformed lugs may also constitute blocking means. The two lugs of each pair of lugs are preferably offset from each other when viewed from the front side (or from the rear side) of the sheath.

In addition to blocking means and retaining means, the sheath is preferably provided with restraining means which engages the cap in such a manner as to make it necessary for the user to exert significant force to slide the sheath from its locking state to its release state. The restraining means is preferably constituted by a part or parts of the sheath deformed after the partially formed sheath has been slid onto the cap. While the restraining means may be constituted by the blocking means and/or the retaining means it is preferred to arrange for the restraining means to be separate and distinct from both the blocking means and the retaining means.

The sheath for a single-sided cap preferably includes a pair of deformable parts, distinct from the lugs, one on each side of the sheath, only one of those parts actually being deformed to form restraining means, during assembly of the sheath with the pin. Likewise, the sheath for a double-sided cap preferably includes two pairs of deformable parts, distinct from the lugs, the two deformable parts of each pair being on opposite sides of the sheath, and the deformable parts being so disposed that only one deformable part of each pair is actually deformed, during assembly of the sheath with the pin, to form restraining means, the parts that are deformed being on opposite sides of the sheath. In each such arrangement, it is the orientation of the sheath on the cap that determines which one of each pair of deformable parts is in fact deformed to form restraining means.

When one of those deformable parts is deformed to form restraining means it is preferably pinched inwards to come into frictional engagement with a part of the cap, such as the base of the tongue, where a tongue is provided, and thus to resist movement of the sheath from its locking state to its release state. That frictional engagement may occur during only a part of the travel of the sheath between its locking and release states.

Preferably a partially formed sheath, for use with a safety-pin of the kind specified and with a double-sided cap having a tongue, comprises a top portion of inverted channel shape, a first end portion depending from one end of the top portion, and a second end portion depending from the other end of the top portion, the two end portions each being of channel-like shape, with the channels opening towards each other, each said end portion having two lugs, that is one lug on each side, and two deformable parts separate and distinct from the lugs, that is a deformable part on each side, the arrangement being such that the sheath can be slid onto the cap of the pin in either of the two possible orientations, and after its having been slid onto the cap the two lugs on that end portion adjacent to the recess are bent inwards to form retaining means, and the deformable portions on the other end portion, that is the end portion adjacent to the base of the tongue are pinched inwards to form restraining means.

The unformed sheath can therefore be assembled with the associated cap in either orientation indiscriminately or at random. In use the lugs on that end portion of the sheath adjacent to the base of the tongue would not normally be bent inwards, and similarly the deformable portions on that end of the sheath adjacent to the recess would not normally be pinched inwards.

Embodiments of the invention will now be described, by way of example, with reference to the accompanying drawings, in which:-

Figure 2:
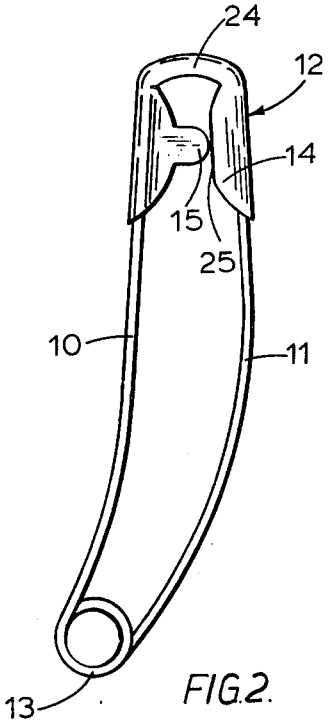
Figure 3:
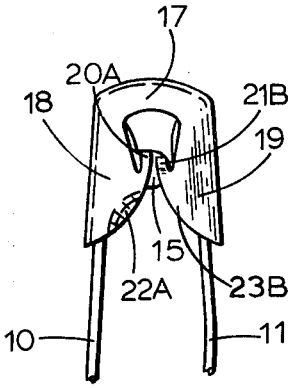
Figure 4:
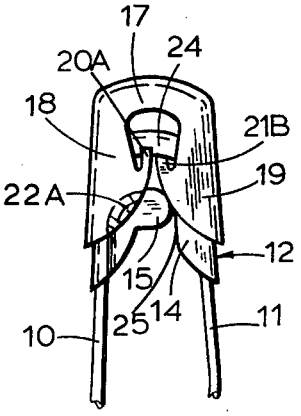
Figure 5:
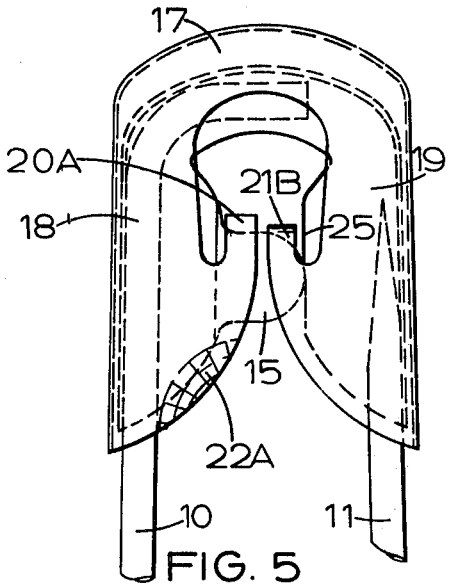
Figure 6:
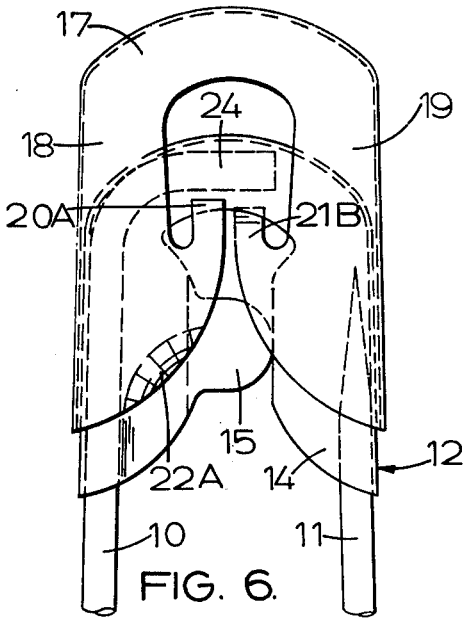
Figure 7:
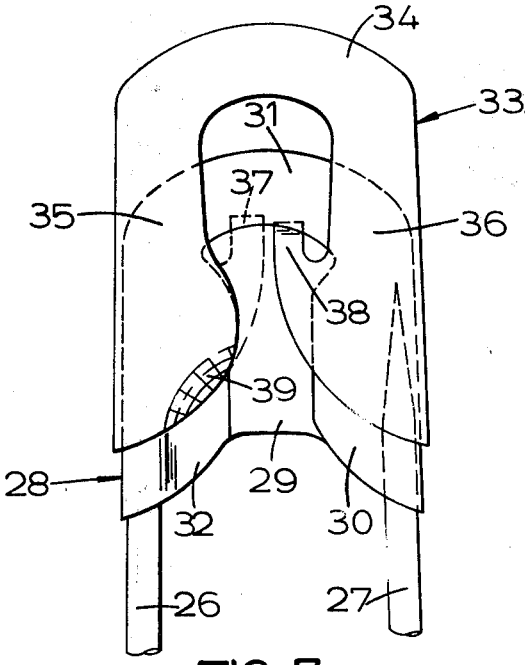

FIG. 1 is a side view of a partially formed sheath for assembly with a double-sided safety-pin, to form an assembly embodying the present invention, FIG. 2 is a side view of a double-sided safety-pin intended for assembly with the sheath shown in FIG. 1, FIG. 3 is a side view of the upper part of an assembly embodying the present invention and assembled from the safety-pin shown in FIG. 2, with locking means made from the sheath shown in FIG. 1, the locking means being shown in its locking state, FIG. 4 is similar to FIG. 3 but shows the locking means in its release state, FIG. 5 is similar to FIG. 3 but to a larger scale and shows in broken lines various concealed parts, FIG. 6 is similar to FIG. 5 but shows the locking means in its release state, and FIG. 7 is a side view of the upper part of an assembly embodying the present invention and comprising a single-sided safety-pin with a locking sheath, the locking sheath being shown in its release state.

The safety-pin shown in FIG. 2 comprises a length of resilient wire bent to form a first limb 10 and a second limb 11, the limbs being spaced apart and approximately parallel with each other. The first limb 10 has a cap 12 at one end and is connected at the other end to the second limb 11 through the intermediary of a spring coil 13 integral with the limbs. An end portion of the second limb 11 remote from the coil 13 is shaped to form a point and is releasably engageable with the cap 12. The pin is shown in its closed state, in which the end portion of the second limb is disposed in a recess in the cap defined by spaced wings 14, the recess opening towards the first limb 10. The pin can also take up an open state (not shown) in which the end portion of the second limb 11 is released from the recess, and the second limb is urged by the coil to a position somewhat further away from the first limb. The arrangement is such that the pin can be moved from its open state to its closed state first by movement of the second limb 11 towards the first limb 10 so that the end portion of the second limb lies to one or the other side of the cap 12 as desired, then by movement of the second limb so that the end portion abuts a tongue 15 on the cap, which tongue projects towards the recess from a part of the cap facing the recess, and finally by release of the first limb so that the end portion of the second limb moves into the recess owing to the resilience of the spring coil 13, the end portion being guided into the recess by the tongue 15.

The partially formed sheath 16 shown in FIG. 1 is intended to be assembled with the pin shown in FIG. 2 so as to constitute blocking means. The partially formed sheath 16 comprises a top portion 17 of inverted channel shape. A first end portion 18 depends (or hangs) from one end of the top portion 17, and a second end portion 19 depends from the other end of the top portion. It is to be understood that both here and elsewhere in this description terms such as "top" and "depend" are used in a relative sense, for convenience of description, and that they are not to be construed as implying any limitation on the position of the sheath during assembly or in use. Each of the end portions 18 and 19 is of channel-like shape, with the channels opening towards each other. End portion 18 has two lugs, 20A and 20B, one lug being on each face of the sheath. Only the nearer lug 20A is visible in FIG. 1, the other lug 20B being hidden behind it. End portion 19 also has two lugs, 21A and 21B, one lug being on each face of the sheath. Only the nearer lugs 21B is visible in FIG. 1, the other lug 21A being hidden behind it. The lugs 20A and 21B constitute one pair of lugs on one side of the sheath and the lugs 21B and 21A constitute a second pair of lugs on the other side of the sheath. The two lugs of each pair are thus on opposite sides of the sheth and are offset from each other.

Likewise, end portion 18 has two deformable parts 22A and 22B, one on each face of the sheath, only the nearer 22A being visible in FIG. 1. End portion 19 also has two deformable parts 23A and 23B, one part being on each face of the sheath. Only the nearer part 23B is visible in FIG. 1, the other such part 23A being hidden behind it. The parts 22A and 22B constitute one pair of deformable parts, and the deformable parts 23B and 23A constitute a second pair of deformable parts. The two deformable parts of each pair are thus on opposite sides of the sheath and are offset from each other.

The partially formed sheath 16 is symmetrical in that it has mirror-symmetry about two planes at right-angles to each other.

In assembly of the partially formed sheath 16 with the pin, the sheath is slid onto the cap 12. The sheath can be slid onto the cap in either of two different orientations, which differ from each other by a rotation through half a complete revolution. In assembly the sheath is slid onto the cap in either of those orientations at random. While the operation can be carried out by hand it is preferably carried out automatically by a machine. In the operation of a typical machine, successive pins are mounted cap-end upwards in a carrier which indexes them one by one to a station to which partially formed sheaths are also supplied. At that station each successive cap has an associated partially formed sheath slid onto it.

After the partially formed sheath 16 has been slid onto the cap 12 the two lugs on that end portion of the sheath adjacent to the wings 14 are bent inwards, towards the tongue 15, to form retaining means and blocking means. In the example illustrated in FIGS. 3 to 6, it is the lugs 21A and 21B, on the end portion 19, that are bent inwards; had the sheath been slid onto the cap in the other orientation it would have been the lugs 20A and 20B that were bent inwards. In the example illustrated, the other pair of lugs, 20A and 20B, remain in their original states and serve no purpose in the finished assembly.

In addition to the lugs being bent the two deformable parts on the other end portion, that is on the end portion adjacent to the base of the tongue 15, are pinched inwards to form restraining means. In the example illustrated, it is the deformable parts 22A and 22B that are pinched inwards to form the restraining means, the parts 23A and 23B remaining in their original states.

The deformation of the lugs and of the deformable parts may be effected manually, but is preferably effected by reciprocating forming tools disposed at a station or stations to which the pins are indexed. The forming tools may be of a known kind; for example the lugs may be deformed by a pair of tools which move towards each other along a common axis, engage the lugs from opposite sides of the sheath, and deform the lugs. The tools then withdraw and repeat their movements to engage and deform the lugs on the next succeeding sheath. The tools for deforming the deformable parts are similar and operate in a similar manner.

FIGS. 3 and 5 show the sheath in its locking state, the safety-pin being in its closed state. When the pin and sheath are in those states the blocking means, constituted by the two bent lugs 21A and 21B, blocks the exit to the recess defined by the wings 14 and so prevents the end portion of the second limb 11 of the pin leaving the recess, and prevents the pin being moved to its open state. If the lugs 21A and 21B are bent inwards to a lesser extent they no longer act as blocking means on their own, but the gap between the two lugs on each side of the sheath is too narrow to allow the pin to be moved to its open state, so that the lugs together then serve as blocking means.

The sheath can, however, be slid to its release state, shown in FIGS. 4 and 6. To slide the sheath to the release state the user has to exert a significant force because movement of the sheath from the locking state is resisted by the frictional engagement between the two pinched-in parts 22A and 22B and a portion of the tongue 15. The force required is such that it is extremely unlikely that in use the sheath would move unintentionally or inadvertently to the release state; nevertheless the force is no greater than could be readily exerted by a normal adult user.

Sliding movement of the sheath beyond its release state, and consequent removal of the sheath from the cap, is prevented by the engagement between the two bent lugs 20 and a top portion 24 of the cap 12. The bent lugs thus constitute retaining means. The top portion 24 is of inverted channel shape, and the ends of the bent lugs preferably enter the channel so as positively to prevent removal of the sheath.

When the sheath is in its release state the two bent lugs 21A and 21B no longer block the exit to the recess, with the result that the end portion of the second limb 11 can readily leave the recess, by passing to either side of the tongue 15 at will, and the pin can be moved to its open state.

While the invention may be applied to safety-pins of known designs, it should be noted that the pin shown in FIG. 2 includes a minor modification from what is conventional in that the edges 25 of the wings 14 defining the recess are cut back a little and are substantially rectilinear instead of the usual convex shape. The reason for this is that the presence of two lugs on each side of the sheath makes it necessary for the bent lugs to be a little closer to the bottom of the recess than is the case when there is only a single lug on each side of the sheath as is usual in designs previously used.

FIG. 7 shows the upper part of a single-sided safety-pin fitted with a locking sheath. The pin is largely similar to that shown in FIG. 2, having a first limb 26 and a pointed second limb 27 interconnected by a spring coil (not shown) like the coil 13. The pin has a cap 28 somewhat similar to the cap 12 but open on only one side (the front) of the pin, the other side (the rear) being closed by a plate 29 which is integrally connected to the rear wing of a pair of spaced wings 30 defining the recess for receiving the end portion of the second limb 27. At the top, the plate 29 is integral with the rear wall of the portion 31 of inverted channel shape. An integral extension 32 of the plate is wrapped tightly round the first limb 26 opposite to the recess.

The locking sheath 33 comprises a top portion 34 of inverted channel shape and end portions 35 and 36 depending from opposite ends thereof, the portions 35 and 36 also being of channel shape and opening towards each other. The end portion 35 has a lug 37 at the rear, while the end portion 36 has a lug 38 at the front, the lugs initially resembling the lugs 20B and 21B respectively. The end portion 35 has a deformable part 39 at the front, while the end portion 36 has a similar deformable part (which is concealed in FIG. 7) at the rear. The sheath 33, before assembly with the pin, is therefore symmetrical to the extent that its appearance is unaltered when it is rotated through half a complete revolution.

During assembly the sheath 33 is slid onto the cap 28 in either of its two possible orientations at random. The lug at the front is bent inwards to constitute retaining means and blocking means, and the deformable part at the front is pinched inwards to form restraining means. In the embodiment illustrated it is the lug 38 and deformable part 39 that are thus deformed, but had the sheath being assembled with the cap orientated in its other position, the other lug 37 and the other gripping portion would have been deformed.

In manufacture the deformation may again be effected manually or with the aid of mechanically operated tools. The tools may be similar to those described above, with the difference that the rear tool of each axially-aligned pair is omitted, and is replaced by a fixed reaction member which supports the rear face of the sheath while the front tool is operating on the front of the sheath.

The components of the pin and sheath assembly may in each case be made from any suitable materials. For example, it is preferred to make the wire limbs and spring coil from stainless steel, though a less expensive material such as high tensile steel may be used if desired. The cap is preferably made from nickel-plated brass, though it may be made from a less expensive material such as ductile mild steel. The sheath, like the cap, is preferably made from nickel-plated brass, but may also be made from a less expensive material such as ductile mild steel. In the latter case it is preferred to coat the sheath, both to protect it and to enable it to be coloured. It is preferred not to coat the cap, however, as any coating tends to be locally worn away by the repeated movement of the sheath. The coating may comprise a paint-like plastics material, which may be applied to sheet metal from which the sheath is then formed, or which may be applied to the partially-formed sheath, as by an electrostatic method, before it is assembled with the cap.

I claim:

1. Blocking means for preventing unintentional opening of a safety pin of the type having a first limb to one end of which is affixed a cap having a recess opening in the direction of that limb and a second limb resiliently fixed to the first limb and movable to and from a position wherein an end portion of the second limb is received and resiliently retained within the recess within said cap, said blocking means comprising a substantially U-shaped sheath having first and second inwardly facing recessed sides of a size to be slidingly received over said cap, a pair of lugs one on each of the sides of said sheath, said lugs being deformable and so positioned that irrespective of the intitial orientation of a sheath relative to said cap when the sides of said sheath are first slid over said cap one of said lugs is always located relative to the recess of said cap for deformation to provide retaining means for preventing separation of said sheath from said cap.

2. Blocking means according to claim 1 wherein the cap is so shaped as to permit the end portion of the second limb to enter the recess from either side of the cap at will, and each side of the sheath includes a pair of lugs, the two lugs of each pair being on opposite faces of the sheath, and the lugs being so disposed that either pair of lugs are deformable to provide said retaining means, regardless of the initial orientation of said sheath with resect to said cap.

3. Blocking means according to claim 2 characterised in that the two deformed lugs also constitute blocking means.

4. Blocking means according to claim 2 including restraining means operative to engage the cap in such a manner as to make it necessary for the user to exert significant force to slide the sheath from a blocking position to a release position, said restraining means comprising a pair of deformable parts distinct from said lugs on each side of said sheath, the two deformable parts of each pair being on opposite faces of the sheath, and being so positioned that irrespective of the initial orientation of said sheath relative to said cap when the sides of said sheath are first slid over said cap, one of said pair of deformable parts is always located relative to said cap for deformation to provide said retaining means.

5. The blocking means of claim 4 wherein said cap includes a tongue projecting into or close to the mouth of the recess from a part of the cap facing the mouth of the recess, a pair of said deformable parts being always located so that upon deformation said parts frictionally engage the base of said tongue.

6. The blocking means according to claim 1 wherein said cap is so shaped as to permit the end portion of the second limb to enter the recess, during manipulation of the pin to its closed state, only from one side of the cap, said sheath including a pair of lugs, one on one face of one side of the sheath and the other on the opposite face of the second side of the sheath, said lugs being located that during assembly of the sheath with said cap one lug of the pair is always positioned to be deformed to provide said retaining means, the deformed lug entering said one side of said cap.

7. The blocking means of claim 6 wherein said one lug also constitutes said blocking means upon deformation of said lug.

8. Blocking means according to claim 6 including restraining means operative to engage the cap in such a manner as to make it necessary for the user to exert significant force to slide the sheath from a blocking position to a release position, side restraining means comprising a pair of deformable parts distinct from the lugs, one part being on one face of one side of the sheath and the other part being on the opposite face of the other side of said sheath, said parts being located that one part is always properly in position during initial assembly regardless of the orientation of the sheath with respect to said cap that said part may be deformed to provide said restraining means.

9. Blocking means for preventing unintentional opening of a safety pin of the type having a first limb to one end of which is affixed a cap having a recess opening in the direction of that limb and a second limb is received and resiliently retained within the recess within said cap said cap being so shaped as to permit said end portion of the second limb to enter the recess from either side of the cap at will, said cap including a tongue projecting into or close to the mouth of the recess from a part of the cap facing the recess, said sheath comprising a top portion of inverted channel shape, a first end portion depending from one end of the top portion, and a second end portion depending from the other end of the top portion, the two end portions each being of channel-like shape, with the channels opening towards each other, each said end portion having two lugs, one on each face of each said end portion, and two deformable parts, one on each face of each said end portion, the two lugs on that end portion adjacent to the recess of said cap being bent inwards to form restraining means, and the deformable parts on the end portion adjacent to the base of said tongue being pinched inwards to form restraining means, said lugs and said deformable parts being located on said sheath that two of said lugs and two of said deformable parts are always located for said bending and pinching respectively regardless of the initial orientation of said sheath relative to said cap.

* * * * *